United States Patent [19]

Dorman

[11] Patent Number: 4,977,694

[45] Date of Patent: Dec. 18, 1990

[54] MULTI-CHANNEL TRANSPARENT JACKET FOR MICROFILM STRIPS HAVING NOTCHED DUMMY STRIP

[75] Inventor: Isidore Dorman, Whitestone, N.Y.

[73] Assignee: NB Jackets de Puerto Rico

[21] Appl. No.: 798,874

[22] Filed: Nov. 18, 1985

[51] Int. Cl.[5] ..... A47G 1/06; G09F 1/10

[52] U.S. Cl. ..... 40/159

[58] Field of Search ..... 40/159, 159.2, 537, 40/405, 359, 360, 585, 536

[56] References Cited

U.S. PATENT DOCUMENTS

| | | | |
|---|---|---|---|
| 1,263,589 | 4/1918 | Moore | 40/537 |
| 3,238,655 | 3/1966 | Engelstein | 40/159 |
| 3,312,009 | 4/1967 | Beispel | 40/159 |
| 3,553,430 | 1/1971 | Dorman | 40/159 |
| 3,736,680 | 6/1973 | Dahl | 40/159 |
| 3,807,074 | 4/1974 | Owens et al. | 40/159 |

*Primary Examiner*—Kenneth J. Dorner
*Assistant Examiner*—J. Hakomaki

[57] ABSTRACT

A multi-channel transparent jacket having top and bottom panels joined by ribs to define parallel channels loadable with microfilm strips to create a reproducible microfiche master, the jacket having entry slots adjacent the front end of the channels to facilitate insertion of the strips. The lowermost channel is pre-loaded with a removable dummy strip to stiffen or somewhat thicken this channel and thereby prevent a partially-loaded jacket from buckling or sliding under when a stack of jackets is stored in a file drawer. The ends of the dummy strip are notched to facilitate the later loading of the lowermost channel through the channel entry slot with a film strip which displaces the dummy strip.

3 Claims, 2 Drawing Sheets

MOTOR CONTROL CIRCUIT
INDIVIDUAL JACKET
GUIDE ROLLER
IN-SITU RIB
DT
ES
SS
R1
R2
R3
N

MULTI-CHANNEL TRANSPARENT JACKET FOR MICROFILM STRIPS HAVING NOTCHED DUMMY STRIP

BACKGROUND OF INVENTION

1. Field of Invention:

This invention relates generally to multi-channel transparent jackets whose channels are loadable through respective entry slots with microfilm strips to create a reproducible microfiche master, and more particularly to a jacket of this type in which the lowermost channel is pre-loaded with a dummy strip to stiffen or somewhat thicken this channel and, thereby prevent a partially-loaded jacket from buckling or sliding under when a stack of jackets is stored in a file drawer.

2. Prior Art:

The Engelstein U.S. Pat. No. 3,238,655, entitled "Microfiche Master," discloses a microfiche master composed of a transparent jacket formed by two transparent plastic panels laminated together by ribs which are spaced to define a series of parallel channels or chambers adapted to accommodate microfilm strips. The loaded, multi-chambered jacket functions as a microfiche master from which reference copies may be made. This is effected by contact-printing through the front panel which is quite thin, the back panel being thicker to impart body to the jacket. Such microfiche masters are highly useful in storing and disseminating information.

The Engelstein patent points out that to facilitate contact-printing it is important not only that the top panel of the jacket be thin to minimize the separation between the sensitive film of the contact-printer and the microfilm strip in the jacket so as to obviate a loss of optical definition, but it is also essential to avoid any space between the film strip and the overlying top panel. Since this spacing is determined by the ribs which separate the top panel from the bottom panel of the jacket, the thickness of the ribs is made substantially equal to the thickness of the microfilm strip for which the jacket is intended. Thus, the film strip is snugly received within the chamber.

The Dorman U.S. Pat. No. 3,872,645 discloses a machine for loading microfilm into a microfiche jacket, the machine functioning to section the microfilm into strips and to insert the cut pieces into the channels of the microfiche jacket. By the use of this machine, insertions are made by placing the microfiche jacket on an inclined platform carriage which is shiftable to register successive jacket channels with the leading edge of the incoming film, the film being guided along a trackway terminating adjacent the edge of the platform. In operation, a section of the film constituted by one or more microfilm frames is advanced into a selected channel and the trailing edge of the section is severed. The platform is then indexed to the next chamber position for a new insertion.

To facilitate insertion of film strips, the microfiche jacket is provided with entry slots adjacent the front end of the channels, thereby making it possible to insert the film laterally at an angle to the plane of the jacket rather than in an endwise direction which entails exact co-planar alignment of the film with the jacket.

In the jacket disclosed in the Engelstein patent, preformed plastic or paper ribs are adhesively secured to the top and bottom panels. Hence the spacer ribs act as carriers for an adhesive agent to effect lamination. In the Dorman U.S. Pat. No. 4,452,666, there is disclosed a technique for producing a multi-channel jacket in which the channels are defined by "in situ" plastic ribs which are integral with the top and bottom channels of the jacket and serve to maintain a desired spacing therebetween.

These in situ ribs are formed by extruding a set of molten streams of plastic material in parallel paths, the streams in their molten state being fed between webs of transparent "Mylar" panel material advancing toward combining rolls, whereby the streams are compressively bonded to the webs and are integrated therewith to define ribs whose thickness is precisely determined by the adjustable nip of the combining rolls and whose width depends on the cross-sectional area of the streams, which area is controllable. Thus, the same machine may be used to produce jackets for accommodating microfilm strips in a range of gauges, without having to change the rib supply as in prior machines wherein each rib is preformed by a plastic or paper ribbon drawn from a reel.

When loading a multi-channel transparent jacket of the type heretofore known with strips of microfilm, one normally starts with the uppermost channel. Then the channels therebelow are successively filled to an extent depending on how much documentation is to be carried in a given jacket. Since the resultant microfiche master is updatable at a later time, the lowermost channel is often vacant, for this is always the last to be loaded.

Assuming, for example, a transparent jacket having five channels, each capable of storing a microfilm strip of a length carrying ten frames, the maximum capacity of the jacket is then fifty frames. If this jacket is used for record purposes in a commercial operation, say, to provide a microfiche master for orders placed from time to time by a given account, each of which is microfilmed on a separate frame, then the microfilm jacket, when partially loaded, may have only 20 frames, and the lower channels may remain vacant until such time as subsequent orders are microfilmed and loaded into these channels.

The normal commercial practice is to store the microfiche masters for the various accounts in a file drawer so that when a need exists for a reference copy of a particular master, one can withdraw this master from the drawer for contact printing, and then return the master to the file.

The film strips inserted in the channels of the jacket act to somewhat thicken and thereby rigidify the jacket structure. In practice, the thickness of the microfilm strip is slightly greater than that of the empty channel defined by the ribs, so that it is snugly recessed therein. As a consequence, a loaded channel is somewhat thicker and stiffer than an unloaded channel. If all channels are more or less loaded, save for the lowermost channel, when a stack of jackets is stored in a file drawer or cabinet, a jacket having an unloaded and unstiffened lowermost channel which rests on the bottom of the drawer may buckle or slide under. As a consequence, the jacket will curl within the drawer and become inaccessible to the user of the file.

In a copending application Ser. No. 651,715, filed Sept. 18, 1984, entitled "Multi-Channel Transparent Jacket for Microfilm Strips," there is disclosed a multi-channel transparent jacket whose channels are loadable with microfilm strips to create a microfiche master, the lowermost channel being pre-loaded with a removable dummy strip which acts as a stiffener to prevent the master, when partially loaded with film strips, from buckling under in a file drawer. In manufacturing this jacket, streams of molten plastic emerging from an extruder along parallel paths are fed continuously between upper and lower webs of transparent panel material into combining rolls in which the streams are compression-bonded to the webs to create the ribs, the combined webs then being sectioned into individual jackets. Also fed continuously into the combining rolls between the two adjacent streams which form the ribs defining the lowermost channel of the jacket is a tape whose width and thickness corresponds to those of a microfilm strip for which the jacket is intended. In sectioning, this tape forms the dummy strip pre-loaded in the jacket.

As pointed out in the above-identified copending application, since the dummy strip runs the full length of the lowermost channel in the jacket, it blocks the entry slot thereto. This makes subsequent removal of the dummy strip difficult, for the operator has no access by way of the channel entry slot to the lowermost channel.

In order to provide a dummy strip having a length that falls short of the full length of the lowermost channel, the copending application discloses an alternative method in which intermittently fed into the combining rolls in sequence are pre-cut dummy strips of the required shorter length, so that the leading edge of the dummy strip is aligned with the entry slot. In this way, one can push the dummy strip out of the lowermost channel by using the means available for this purpose in a microfilm jacket loading machine of the type disclosed, for example, in the Dorman U.S. Pat. No. 3,872,645, in which, as the microfilm is being loaded in any channel through the entry slot for that channel, it acts to advance whatever strip already occupies that channel. Hence, when loading the lowermost channel with a microfilm strip, the advancing strip will at the same time push out the dummy strip.

The practical drawback to this alternative method is that it is no longer possible to feed a continuous dummy strip tape into the combining rolls, and the need to dispense individual dummy strips is difficult to carry out in practice, for it requires a relatively complex strip dispenser mechanism for this purpose.

SUMMARY OF INVENTION

In view of the foregoing, the main object of this invention is to provide a multi-channel transparent jacket whose channels are loadable with microfilm strip through entry slots adjacent the front end of the jacket to create a microfiche master, the lowermost channel being pre-loaded with a removable dummy strip which acts as a stiffener to prevent the master, when partially loaded with film strips, from buckling or sliding under in a file drawer containing a stack of jackets.

More particularly, an object of this invention is to provide a jacket of the above type in which the channels are defined by in situ ribs which are integral with the superposed front panels and serve to maintain a desired spacing therebetween to snugly receive microfilm strips of a given gauge, the dummy strip pre-loaded in the lowermost channel being of the same gauge.

A significant feature of the invention is that the ends of the dummy strip are formed with opposed notches to define a narrow half tie which, though at one end it underlies the entry slot to the lowermost channel, does not block the channel, so that a film strip may later be inserted therein.

Briefly stated, these objects are attained in a multichannel transparent jacket having top and bottom panels joined by ribs to define parallel channels loadable with microfilm strips to create a reproducible microfiche master, the jacket having entry slots adjacent the front end of the channels to facilitate insertion of the strips. The lowermost channel is pre-loaded with a removable dummy strip to stiffen or somewhat thicken this channel and thereby prevent a partially-loaded jacket from buckling or sliding under when a stack of jackets is stored in a file drawer.

In manufacturing the jacket, streams of molten plastic emerging from an extruder along parallel paths are fed continuously between upper and lower webs of transparent panel material into combining rolls in which the streams are compression-bonded to the webs to create the ribs, the combined webs then being sectioned into individual jackets. Also fed continuously into the combining rolls between the two adjacent streams which form the ribs defining the lowermost channel of the jacket is a tape whose width and thickness are approximately equal to those of a microfilm strip for which the jacket is intended. The tape is provided at equi-spaced positions with a pair of opposed notches to define a connecting tie along the longitudinal axis of the tape. In sectioning, this tape forms the dummy strip pre-loaded in the jacket, each end of the dummy strip being defined by a half-tie, one of which underlies the entry slot to the lowermost channel without, however, blocking the slot. Thus, a microfilm strip may be inserted therein to displace the dummy strip.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Microfiche Master

Figure 1:
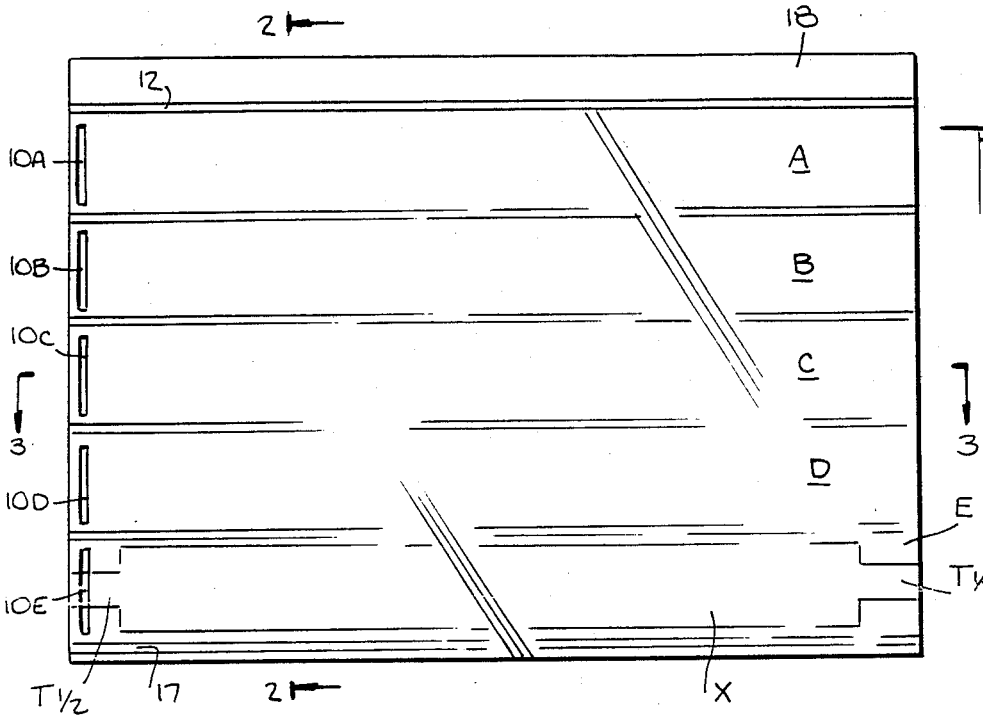
FIG. 1 is a plan view of a multi-channel jacket in accordance with the invention having a pre-loaded dummy strip in the lowermost channel.
Figure 3:
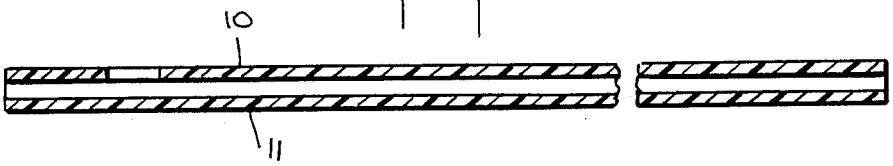
FIG. 3 is a longitudinal section taken in the plane indicated by 3—3 in FIG. 1.
Figure 2:
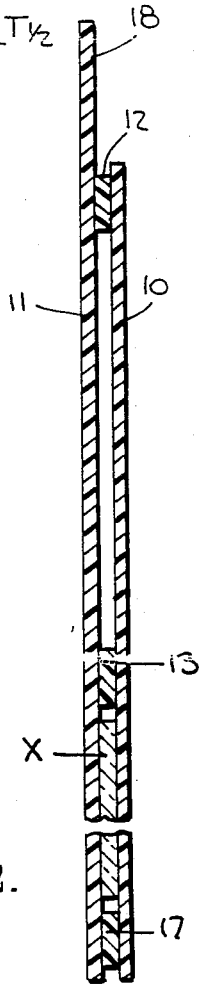
FIG. 2 is a transverse section taken in the plane indicated by line 2—2 in FIG. 1.

Referring now to FIGS. 1, 2 and 3, showing a microfiche master in accordance with the invention, the master is constituted by a transparent multiple-chamber jacket having parallel channels or chambers A, B, C, D, and E. The channels are adapted to accommodate strips of microfilm, so that the loaded or partially loaded jacket then functions as a reproducible microfiche master from which reference copies can be made by contact printing.

The microfilm strips need not be inserted one at a time, and in practice, additional strips may be added to supplement an existing record. For example, if each chamber has a capacity of ten film frames, then if the first inserted strip is four frames long, there is still room for six more frames. It is important, however, that the second film chip or strip not override the first, for then the microfiche would not be usable. Hence, one reason why it is vital that strips be snugly contained in the channels is in order to prevent a later-inserted film strip from riding over a previously-inserted strip.

The jacket is comprised of two transparent rectangular panels 10 and 11 in superposed relation, the panels being formed of clear, flexible plastic material, preferably a polyester or Mylar (polyethylene terephthalate) film. Polyester material is advantageous because of its exceptional clarity, high strength and dimensional stability.

Interposed between the top and back panels and integral therewith are longitudinally-extending in situ ribs 12, 13, 14, 15, 16 and 17. These ribs are of the same or of a similar material as the panels and lie in parallel relation to define chambers A or E which are open at either end. In practice, the in situ ribs may be formed of polyvinyl chloride, polyethylene or other suitable synthetic plastic material. The chambers are of like or slightly greater width to accommodate microfilm strips of a given size, such as 16 mm film.

The back panel 10 is somewhat wider than top panel 11 to provide a marginal extension 18 for titling the microfiche master. This title will be reproduced in contact-printing, because of the translucence of the coating.

To facilitate insertion of microfilm strips or chips, a series of generally rectangular slots 10A to 10E are cut across back panel 10 adjacent the front end of the chamber openings. Top panel 11 is preferably exceptionally thin (i.e., about one mil or less) to facilitate contact-printing, whereas back panel 10 is preferably of heavier gauge transparent material (i.e., 3 to 5 mils to give body to the microfiche.

The ribs are of substantially the same thickness as the inserted microfilm strips, or slightly thinner, so that the sensitive duplicating film is virtually in contact with the microfilm inserts when contact-printing takes place.

Figure 4:
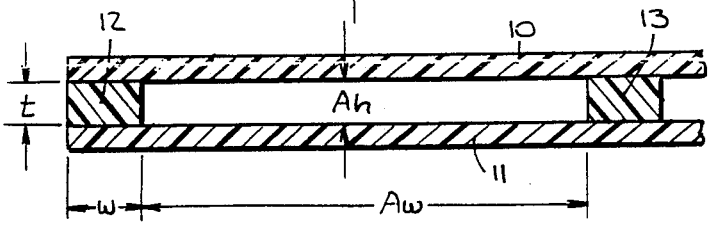
FIG. 4 is a detail of the jacket.

Referring now to FIG. 4, we shall now consider the parameters involved in establishing within the jacket formed by panels 10 and 11, a channel A whose width $A_w$ is slightly wider than the width of the microfilm strip to be inserted therebetween, and whose height $A_h$ is substantially the same as the thickness of the strip. The channel width $A_w$ is determined by the distance between ribs 12 and 13, whereas the channel height is determined by the thickness of these ribs.

When making jackets with pre-formed ribs made of adhesively-coated paper or plastic ribbons, one has merely to supply to the jacket-forming machine a set of ribbons having the desired width and thickness and to maintain the proper spacing therebetween, these ribbons being adhered to the panels. But in the present invention, the ribs are not pre-formed but are created in situ by introducing between the advancing webs of panel material parallel filaments or streams of molten plastic, which streams are compressively bonded to the webs in combining rolls which flatten the streams to an extent transforming the streams into integral ribs having the desired thickness and width. Thus, for microfilm having a thickness of, say, five mils, the in situ ribs in the microfilm jacket intended for this film will have a five-mil thickness or a thickness which is somewhat less than five mils to ensure a snug fit; but for microfilm having, say, a six-mil thickness, the rib thickness will be similarly related thereto.

Pre-loaded in the lowermost channel E and fully occupying this channel is a dummy strip X having a width and thickness or gauge approximately equal to those of the microfilm for which the jacket is intended. This dummy strip, which is readily removable to make way for a microfilm strip, serves to stiffen or slightly thicken the lowermost channel jacket and thereby prevent the jacket, when included in a stack of jackets stored in a file drawer, from buckling or sliding under. The dummy strip is preferably made of opaque colored material so that it is readily distinguishable.

The tendency to buckle or slide under occurs when the other channels are more or less loaded with microfilm and are stiffened and slightly thickened thereby, so that when the partially-loaded jacket stands up in a file drawer, the empty lowermost channel which rests on the bottom of the drawer is then unable to support the loaded channels thereabove and gives way. This tendency is obviated by the dummy strip pre-loaded in the lowermost channel.

Dummy strip X is formed at either end with opposed notches which define a narrow half tie $T_{\frac{1}{2}}$ or tongue that extends along the longitudinal center axis of the channel. The term "half tie" or "tongue" is used in that it is derived by cutting a full tie in half, as will be later explained.

It will be seen that the left hand tongue $T_{\frac{1}{2}}$ underlies the entry slot 10E to the lowermost channel E. Since the width of the channel is at least equal to the width of the dummy strip, then the tongue only blocks the center portion of the slot and leaves the end portions unblocked.

When, therefore, it becomes necessary to update a jacket pre-loaded with an end-notched dummy strip, one must then make accessible for microfilm insertion the lowermost channel. The film strip which is inserted into this channel through the entry slot 10E will not be intercepted by the center tongue 10E. The reason for this is that in this channel whose banks are defined by ribs 16 and 17, the space between the top and bottom panels 10 and 11 is maintained in the channel region adjacent these banks. The space between the panels in the central region of the channel is not maintained by any rib; and since the top panel is quite thin and flexible, it tends to sway, so that the required entry slot clearance for the incoming film strip is provided by the channel regions adjacent the ribs.

Thus, the entry slot is not effectively blocked; for in inserting a film strip into this channel, the leading end of the film strip engages the trailing end of the dummy strip on either side of the tongue and thereby displaces the dummy strip. If the inserted film strip has a length corresponding to the length of the channel, the dummy strip is then fully displaced; but if the film strip is shorter, as may often be the case, the dummy strip is then partially displaced and can be pulled out by the operator.

The Machine

Figures 5, 6, 7, 8:
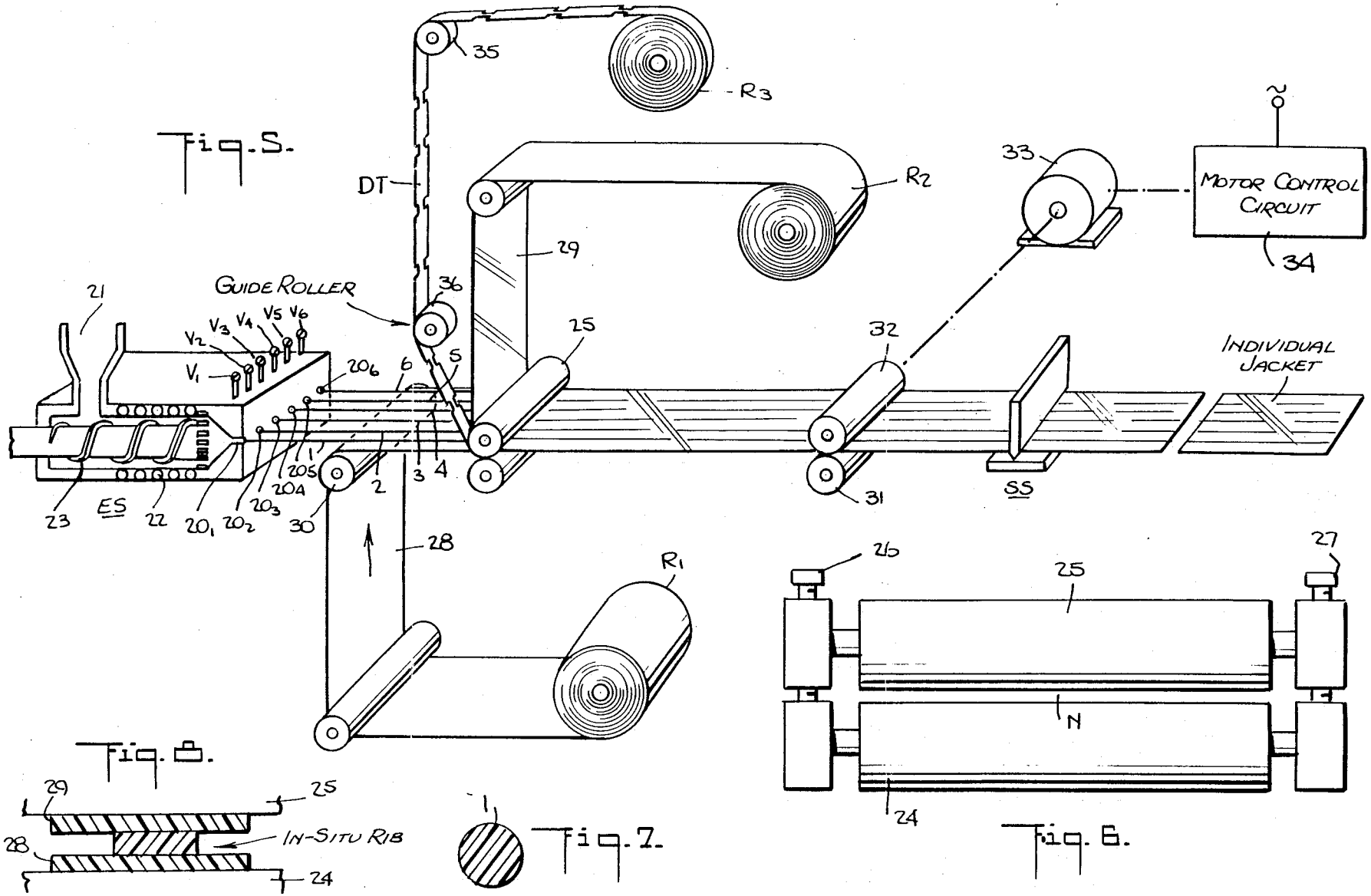
FIG. 5 is a schematic diagram of a machine for mass-producing the jacket.
FIG. 6 is an elevational view of the combining station rolls included in the machine.
FIG. 7 is a section taken through a molten stream before compression.
FIG. 8 is a section taken through the same stream after compression.

A machine in accordance with the invention for making a multichamber jacket of the type shown in FIG. 1 having in situ ribs and a dummy strip in the lowermost channel is illustrated in FIG. 5. The machine consists of an extruding station ES, a combining station CS and a sectioning station SS. The extruding station includes a manifold die head 19 having an array of output nozzles $20_1$, $20_2$, $20_3$, $20_4$, $20_5$ and $20_6$ from which are extruded six parallel filaments or streams 1 to 6 of molten plastic material, preferably having pigment therein to produce colored ribs. The number of operative nozzles and the spacing therebetween depends on the rib requirement of the jacket being produced, and the showing herein is merely by way of example. Each nozzle is controlled by a suitable needle valve $V_1$ to $V_6$.

Except for the manifold head, the extruder is of the conventional type and includes an input hopper 21 to receive raw stock in particulate form which stock may be polyester or any other suitable synthetic plastic material. The stock is rendered molten by heaters 22, the molten material is advanced toward the manifold head by a motor-driven rotating screw 23 and is forced through the dies at a controllable rate.

As shown separately in FIG. 6, the combining station CS is constituted by a lower roll 24 and a complementary upper roll 25 whose spacing relative to the lower roll is adjustable by means of spacing controls 26 and 27 included in the bearings for the upper roll, whereby the nip N between rolls may be set to provide a desired degree of compression.

Drawn from a supply reel $R_1$ and fed into the combining rolls is a lower web 18 of polyester film material suitable for forming the bottom panels of the jacket. Concurrently drawn from a supply reel $R_2$ is an upper web 29 of the same material but of a different gauge suitable for forming the top panels of the jacket.

Lower web 28 is guided by an idler input roll 30, the web drawn from the supply reel $R_1$ passing over this roll and advancing in a horizontal plan toward combining rolls 24 and 25 and continuing from there in the same path toward drive rolls 31 and 32.

Upper web 29 drawn from the overhead supply reel $R_2$ comes down vertically to enter the combining rolls after which it is conducted in a horizontal path toward drive rolls 31 and 32.

Also provided at a position above reel $R_2$ is a third reel $R_3$ carrying a supply of tape DT having a width and thickness appropriate to the requirements of the dummy strip X. The tape is made of relatively stiff paper or plastic material, such as PVC. The tape from reel $R_3$ is conducted continuously by idler rolls 35 and 36 into combining rolls 24 and 25 at a position therein between streams 1 and 2 which define the lowermost channel E of the transparent jacket. From the combining rolls the tape travels between the lower and upper webs 28 and 29 in a horizontal path toward drive rolls 31 and 32.

Figure 9:
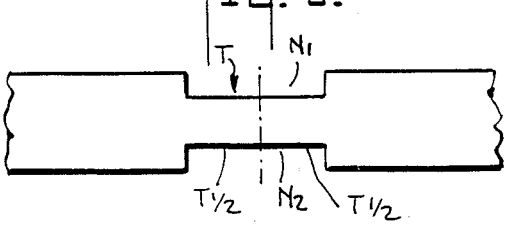
FIG. 9 shows a portion of the notched dummy tape fed into the combining station.

Tape T is provided at equi-spaced positions determined by the required length of a dummy strip with opposed notches $N_1$ and $N_2$ (see FIG. 9). To define a narrow tie T which maintains the continuity of the tape. However, when the tape is later severed at the midpoint of tie T, then the resultant dummy strip has half ties $T_{\frac{1}{2}}$ at either end.

The horizontal surface of lower web 28 in the forward space between idler roll 30 and combining rolls 24 and 25 is exposed and functions as a receiving table for the streams 1 to 6 emerging from nozzles $20_1$ to $20_6$. Die head 19 is horizontally spaced from idler roll 30 so that the portion of extruded streams 1 to 6 extending between the nozzles and the leading edge of the receiving table form an unsupported bridge.

Drive rolls 31 and 32 are operated by a motor 33 whose speed is controlled by a suitable motor control system 34 whereby the motor speed can be set to advance the webs at a rate somewhat greater than the rate at which the streams are extruded. This difference in speed acts to stretch the bridge portion of the streams in taffy-like fashion and to elongate the streams so that the cross-sectional area of each stream laid down on the lower web is somewhat smaller than the area of the streams emerging at the nozzle outputs. This stretching action serves to prevent the unsupported streams in the bridge thereof from sagging. The stretching action also functions to maintain the parallel relation of the streams at the receiving table, for the molten streams are unguided.

The molten streams laid down on the exposed lower web have a generally circular cross-sectional form, as shown in FIG. 7. But when the streams are sandwiched between the upper and lower webs and are compressed by combining rolls 24 and 25, the streams are flattened out, as shown in FIG. 8, to an extent determined by the adjusted nip opening N of these rolls. Hence, the thickness of the ribs is determined by the nip opening, but the width of the ribs depends on the cross-sectional area of the streams.

For example, with a cross-sectional area as shown in FIG. 7, the resultant width of the rib is that produced in FIG. 8, whereas if the nip opening were made smaller to produce a thinner rib, then for the same cross-sectional stream area, the rib would be broader. In jackets for film strips of standard width, it is essential that the ribs all have the same width regardless of whether the ribs are made thin to match thin microfilm strips or are made thicker to match heavier film strips. Hence in setting the machine for making ribs of a given thickness, one must take into account and adjust the cross-sectional area of the molten streams so that the ribs formed in situ have the desired width as well as the desired thickness. This cross-sectional area depends on the nozzle orifice, the rate of extrusion as determined by the rotating extruder screw, as well as the valve setting and the speed at which the webs are advanced.

The molten streams are compressively bonded to the web in the combining rolls to define the desired in situ ribs which proceed to cool, harden and integrate with the webs in their travel from the combining rolls 24 and 25 to drive rolls 31 and 32. From these rolls, the combined webs then enter the sectioning station SS where the web is sliced into individual jackets all having the same length. To provide the necessary entry slots, the bottom web is periodically notched at the appropriate positions. In slicing the combined webs, one also slices the tape in the lowermost channel, so that the individual jackets all include a pre-loaded dummy strip X.

One may also provide a laminated jacket of the prior Engelstein type in which pre-formed ribs are laminated at the top and bottom panels with a pre-loaded removable dummy strip to prevent buckling of such jackets in a file drawer. To this end, a tape of dummy material is fed into the combining rolls between the ribs which define the lowermost channel, the ribs in this instance being coated with adhesive so that in the combining rolls the ribs are laminated to the panels.

The arrangement in FIG. 5 is generally schematic in nature to show the basic mechanisms for producing a jacket in accordance with the invention containing a dummy strip. FIG. 5 does not show the conventional mechanism required for stamping out channel entry slots in upper web 29 and for stamping out the notches in dummy tape DT. In practice, these stamping operations are synchronized with each other so that the tape notches have positions which are properly related to the positions of the entry slots in the web.

Because of possible stretching of the dummy tape and other factors, it may be difficult to maintain the proper relationship of the entry slots to the tape notches when the notched dummy tape DT and the slotted plastic web 29 enter the combining rolls 25 of the machine. In order to effect a correction, when necessary, in the relative position of the tape and the webs entering the combining rolls, one may provide for this purpose a photodetector sensor at the sectioning station SS to produce a light beam which projects through the transparent combined webs and a notch in the opaque dummy strip.

The arrangement is such that a sensing action will take place when the combined webs and the dummy strip are stationary at the sectioning station. Motor 33 which rotates drive rolls 31 and 32, operates intermittently so as to halt the movement of the combined webs and dummy strip momentarily to permit sectioning thereof at the proper cutting position in station SS.

If in the stationary sectioning interval the sensed notch in the dummy strip is properly aligned, the light beam will pass therethrough, but if it is misaligned, the light beam will be blocked by the opaque tape to produce a signal in the output of the photodetector. This signal is applied to an electromagnetic control mechanism for a pinch roll which cooperates with the dummy tape guide roll 36 to momentarily retard the advance of the dummy tape into the combining rolls 22 so as to bring about proper alignment of the dummy tape.

While there has been shown and described a preferred embodiment of MULTI-CHANNEL TRANSPARENT JACKET FOR MICROFILM STRIPS HAVING NOTCHED DUMMY STRIP in accordance with the invention, it will be appreciated that many changes and modifications may be made therein without, however, departing from the essential spirit thereof.

I claim:

1. A multi-channel transparent jacket adapted to be loaded with strips of microfilm to create a reproducible microfiche master, the jacket comprising:

A. transparent top and bottom panels in superposed relation;

B. a plurality of spacer ribs in parallel relation sandwiched between the panels and bonded thereto to define parallel channels loadable with said microfilm strips, said channels each having a transverse entry slot adjacent one end thereof to permit insertion into the channels of a microfilm strip, the width of each channel being slightly larger than the width of the strips for which the jacket is intended, the ribs having a thickness which is close to the thickness of said strips whereby the strips are, when inserted in said channels, snugly held therein; and C. a removable blank dummy strip formed of opaque, relatively stiff, flexible plastic material pre-loading the lowermost channel in the jacket to effect stiffening thereof, such that when the other channels are thereafter more or less loaded with said microfilm strips beginning with the uppermost channel to create a microfiche master which can be included in a stack of jackets stored in a file drawer and will not buckle or slide under in the drawer, said dummy strip having a relatively narrow tongue at at least one end thereof which underlies said slot but does not interfere with the later insertion of a film strip into the slot to displace the dummy strip, said dummy strip having a width and thickness approximately equal to that of a microfilm strip for which the jacket is intended.

2. A jacket as set forth in claim 1, wherein said panels are formed of flexible polyester film material and said ribs are formed in situ of molten plastic which is compatible with the panel material and is compression-bonded thereto to form a monolithic jacket structure.

3. A jacket as set forth in claim 2, wherein said polyester film material is polyethylene terephthalate.

* * * * *